US007949293B2

(12) United States Patent
Osawa

(10) Patent No.: US 7,949,293 B2
(45) Date of Patent: May 24, 2011

(54) IMAGE FORMING SYSTEM

(75) Inventor: Masahiro Osawa, Hamura (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 927 days.

(21) Appl. No.: 11/633,546

(22) Filed: Dec. 5, 2006

(65) Prior Publication Data

US 2007/0187884 A1 Aug. 16, 2007

(30) Foreign Application Priority Data

Jan. 27, 2006 (JP) ..... 2006-018741
Oct. 24, 2006 (JP) ..... 2006-288427

(51) Int. Cl.
*B42C 11/00* (2006.01)
*G03G 15/00* (2006.01)

(52) U.S. Cl. ..... 399/408; 412/4; 412/1; 270/1.01

(58) Field of Classification Search ..... 399/408; 270/1.01; 412/1, 4, 5, 33
See application file for complete search history.

(56) References Cited

U.S. PATENT DOCUMENTS 6,000,894 A * 12/1999 Suzuki et al. ..... 412/11
6,176,410 B1 * 1/2001 Ueda et al. ..... 226/4
2004/0098665 A1 * 5/2004 Kasahara et al. ..... 715/500
2005/0232656 A1 * 10/2005 Asai et al. ..... 399/130

* cited by examiner

*Primary Examiner* — Ren Yan
*Assistant Examiner* — Allister Primo
(74) *Attorney, Agent, or Firm* — Finnegan, Henderson, Farabow, Garrett & Dunner, L.L.P.

(57) ABSTRACT

An image forming system includes image forming device and bookbinding device. Image forming device has operation unit for selecting sheet and cover and control unit for control of warning. Bookbinding device stacks plural sheets, forms a bundle of sheets, and binds a book by wrapping sheets with the cover in a square-shape. Bookbinding device has measuring unit measuring thickness of the bundle of sheets. Control unit calculates difference between length of selected cover, and sum of twice a length of selected sheet and a spine width, and determines warning, based on result of comparison between the difference and a predetermined value; executes determination of warning in first warning mode, based on result obtained with spine width of a set value, and/or in second warning mode, based on result obtained with spine width according to measured thickness of the bundle of sheets; and executes first warning mode prior to bookbinding output.

14 Claims, 16 Drawing Sheets

IMAGE FORMING SYSTEM

This application is based on Japanese Patent Applications No. JP2006-018741 filed on Jan. 27, 2006, and No. JP2006-288427 filed on Oct. 24, 2006, the entire of which is hereby incorporated by reference.

FIELD OF THE INVENTION

The present invention relates to an image forming system that wraps a stack of sheets in a square-shape with a cover and binds a book.

BACKGROUND OF THE INVENTION

There are well known bookbinding devices that wrap a stack of sheets, on which images have been formed by a copier or printer, in a square-shape with a cover, and easily binds a book (refer to Patent Document 1: Japanese Patent Publication TOKKAI No. 2005-335262).

In a bookbinding technology, in general, plural sheets having images formed thereon are first stacked and aligned to form a stack of sheets. Next, an adhesive such as glue is applied on one side of the stack of sheets having been stacked and aligned. Then, a cover is conveyed and stopped at a predetermined position, and is bonded with the side of the stack of sheets applied with the adhesive. Plural sheets and a cover are integrated in such a manner to form a book.

An example of a book formed by a bookbinding device is shown in FIGS. 1A and 1B. FIG. 1*a* shows the state where a cover S2 is not folded, and FIG. 1*b* shows a state where the cover S2 is folded. Book S3 includes a bundle of plural sheets S1 and the cover S2 and is formed in such a manner that the cover S2 wraps the bundle of sheets S1 in a square-shape with a spine S3E. Hereinafter, S3 is referred to as a wrapped book. In a finished form of the wrapped book S3, the side edge SE1 of the sheets S1 and the side edges S2E of the cover S2 are aligned with each other. The cover S2 includes, as shown in FIG. 1*a*, two sheet areas A and a spine area B.

FIG. 2 is a development view of the cover S2, showing length X of the cover S2, length 'a' of the sheets S1, and width 'b' of the spine. G1 represents the area of the front cover and G2 represents the area of the back cover. When the sum of 2*a*, which is the length for two sheets S1, and b, which is the width of the spine, is equal to the length X of the cover S2, as shown in FIG. 2, the side edge S1E of the sheets S1 and the side edges S2E of the cover S2 are aligned with each other, as shown in FIG. 1*b*. Therefore, if a user selects a sheet S1 and others, via an operation panel of a copier or the like, and the expression 'X=2a+b' is satisfied, a properly wrapped book S3 will be output.

A user selects the types of sheets S1 and a cover S2 via an operation panel of a copier or the like before starting a bookbinding output. Herein, if the above described expression 'X=2a+b' is not satisfied upon selection of sheets S1 and the like, that is, if 'X>2a+b' or 'X<2a+b', then it is determined that the side edge S1E of the sheets S1 and the side edges S2E of the cover S2 are not aligned with each other in a finished form of the wrapped book S3. Therefore, a warning of this situation is preferably issued before starting a bookbinding output.

In considering length X of a cover S2, length 'a' of sheets S1 and width 'b' of a spine for issuing a warning before starting a bookbinding output, since size information is stored in the image forming apparatus on lengths X of covers S2 and lengths 'a' of sheets S1, exact values are recognized upon selection of sheets S1 or the like via the operation panel.

However, since the spine width 'b' changes with the thickness of the bundle of sheets S1, an exact width 'b' is not determined upon selection of the sheets S1 and the like. More details will be described in the following. The thickness of a bundle of sheets S1 that decides the spine width 'b' corresponds to the number of sheets S1 being output. However, for example, in a case where plural original document sheets are read by a scanner, the number of sheets S1 is not recognized before all the sheets are read, and accordingly, the thickness of the bundle of sheets S1 is not recognized, before the last page of the plural original document sheets is read after starting of a bookbinding output. Further, even if the number of sheets S1 to be output based on image data is recognized before starting a bookbinding output, variation in thickness of sheets S1 and the Karl amount of the sheets S1 prohibit accurate calculation of the thickness of the bundle of sheets S1 from the number of the sheets S1.

As described above, the accurate value of spine width 'b' is not recognized before starting a bookbinding output. Accordingly, a wasteful bookbinding output will be carried out, if the only following steps and no other steps are taken. That is, it is determined, before starting a bookbinding output, whether the expression 'X=2a+b' is satisfied, with spine width value 'b' only as an approximate value, and based on the determination, a warning is output notifying that the side edge S1E of sheets S1 and the side edges SE2 of a cover S2 will not be aligned with each other in a finished form of a wrapped book S3.

SUMMARY OF THE INVENTION

An object of the invention is to provide an image forming system that prevents a wasteful bookbinding output.

In an aspect of the invention, there is provided an image forming system, including:

an image forming device that forms an image on a sheet, the image forming device having:

an operation unit for selection of a sheet and cover to be used for bookbinding; and a control unit for control of warning; and a bookbinding device that stacks a plurality of the sheets, forms a bundle of the sheets, and binds a book by wrapping the bundle of the sheets with the cover in a square-shape, the bookbinding device including:

a measuring unit for measurement of a thickness of the bundle of the sheets, wherein the control unit:

calculates a difference between a length of the selected cover, and a sum of twice a length of the selected sheet and a spine width, and determines a warning, based on a result of comparison between the difference and a predetermined value;

executes the determination of the warning in a first warning mode that determines issuing of a warning, based on the result for which the difference is calculated with a spine width of a set value, and/or in a second warning mode that determines issuing of a warning, based on the result for which the difference is calculated with a spine width of the measured thickness of the bundle of sheets; and executes the first warning mode prior to bookbinding output.

BRIEF DESCRIPTION OF THE DRAWINGS

FIG. 8 is a detailed view of yet another display screen of the operation unit A4;

DETAILED DESCRIPTION OF THE PREFERRED EMBODIMENTS

Figure 3:
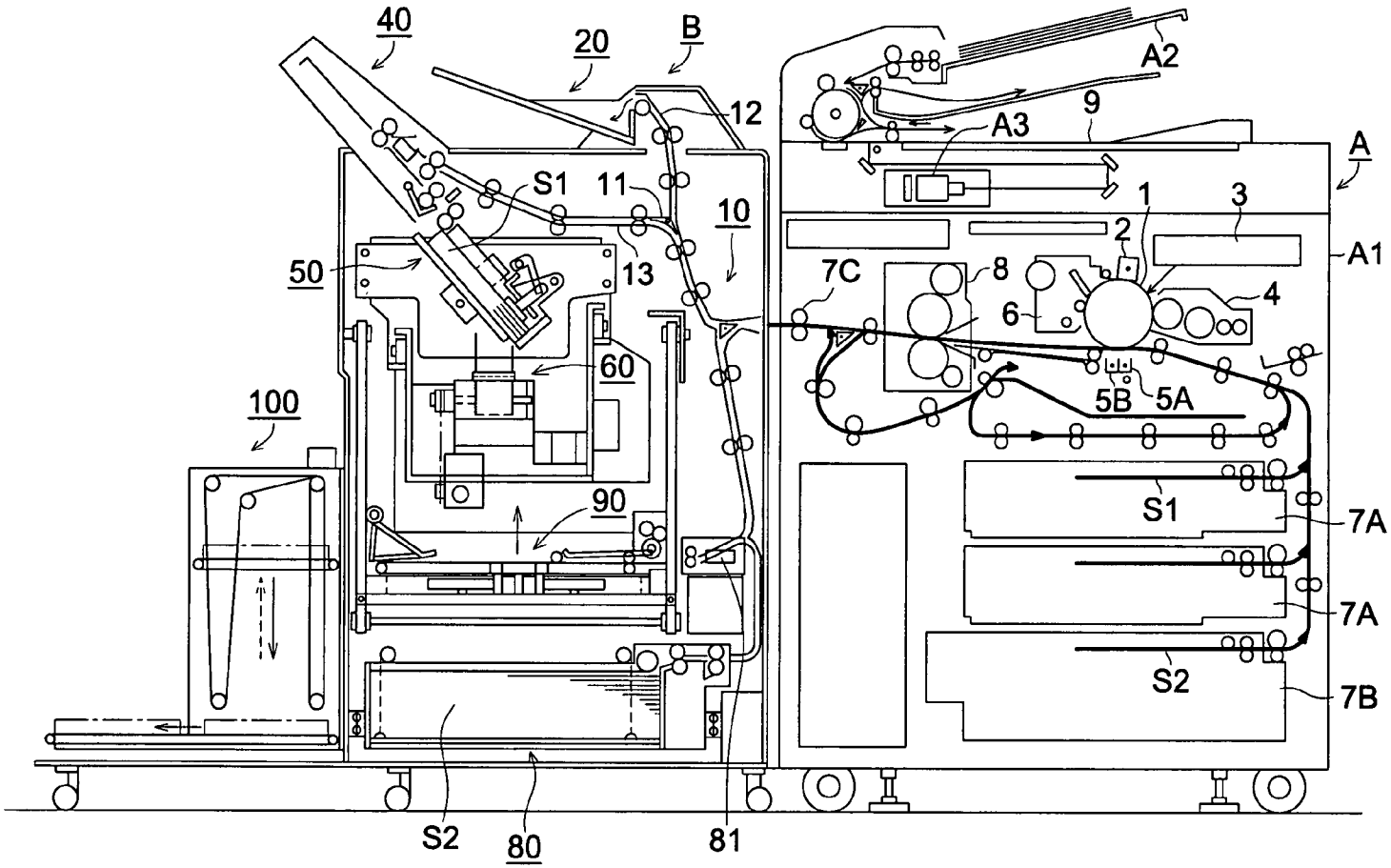
FIG. 3 is a cross-sectional central view of an image forming system.

FIG. 3 is a cross-sectional central view of an image forming system.

The image forming system includes an image forming device A and a bookbinding device B.

The image forming device A forms an image on a sheet by an electrophotographic method and includes an image forming unit A1, original document sheet conveying unit A2, and image reading unit A3. In the image forming unit A1, there are disposed a charging device 2, exposure unit 3, developing device 4, transferring device 5A, separating device 5B, and cleaning device 6, around a drum-shaped photoreceptor. The image forming device A executes processes of charging, exposing, developing, and transferring to form toner images on sheets S1 and a cover S2. Sheets S1 to be wrapped by a cover S2 through bookbinding are stored in two sheet feeding trays 7A, and covers S2 are stored in a sheet feeding tray 7B and a cover storing unit 80 of the bookbinding device B. Sheets S1 and a cover S2 are ejected one by one from the sheet feeding tray 7A and sheet feeding tray 7B and conveyed to the image forming unit A1. The sheets S1 and cover S2 onto which toner images have been transferred pass through a fixing device 8 and are subjected to fixing processing. The sheets S1 and sheet S2 having been subjected to the fixing processing are ejected from ejecting rollers 7C to outside the image forming device A.

The bookbinding device B bundles the plurality of sheets S1 conveyed from the image forming device A into a sheet bundle, and bonds a cover S2 and the bundle and wraps the sheet bundle with the cover S2 in a square-shape so as to bind a book. The bookbinding device B includes a sheet reversing unit 40, stacking unit 50, adhesive applying unit 60, bonding unit 90 for bonding a cover and a bundle of sheets, conveying unit 10, sheet ejecting table 20, and book ejecting unit 100. A switching gate 11 provided in the conveying unit 10 ejects a sheet S1, which has been conveyed from the image forming device A to the bookbinding device B, onto the sheet ejecting tray 20 through an ejecting path 12, or conveys the sheet S1 to the sheet reversing unit 40. A sheet S1 is ejected onto the sheet ejecting table 20 when the sheet is not subjected to bookbinding in the bookbinding device B. In the bookbinding device B, a sheet S1 is conveyed to the sheet reversing unit 40 through the conveying path 13, and after the sheet S1 is switched back at the sheet reversing unit 40, the sheet S1 is conveyed to the stacking unit 50. Sheets S in a number having been set are stacked in the stacking unit 50, and when the number of sheets S1 has reached the set number, the stacking unit 50 rotates so as to hold the bundle of sheets S1 almost vertically. Adhesive is applied by the adhesive applying unit 60 on the bottom surface, namely the spine, of the bundle of the sheets S1, and a cover S2 comes in contact with the bundle of sheets S1 and bonded to the bundle. A wrapped book S3 formed by bonding the cover S2 and the bundle of sheets S1 is ejected to the book ejecting unit 100. Covers S2 are stored in the cover storing unit 80 as well as in the sheet feeding tray 7B. When an image is to be formed on a cover S2, the cover S2 is fed out from the sheet feeding tray 7B, and when no image is to be formed on a cover S2, the cover S2 is fed out from the cover storing unit 80. When a cover S2 is in a long non-regular size, the cover S2 is cut with a cutter 81 being a cutting unit into a predetermined length according to size information on sheets S1 and information on the thickness of the bundle of the sheets S1.

Figure 4:
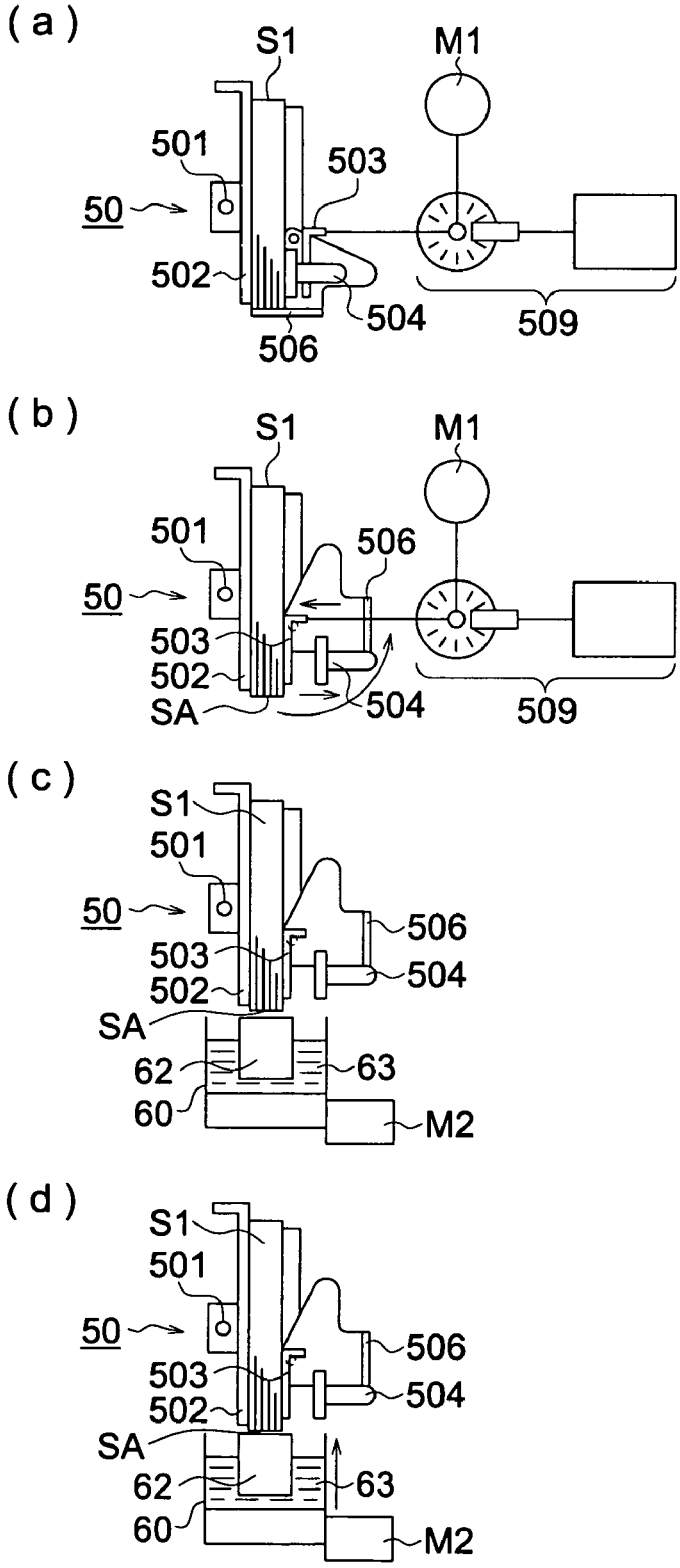
FIG. 4 is a diagram showing a process of applying adhesive on a stack of sheets S1.

FIG. 4 shows the process applying adhesive on a bundle of sheets S1.

The second sandwiching member 503 is moved by a motor M1 toward the sheets S1, and when the second sandwiching member 503 presses the sheets S1 at a certain pressure, a driving torque detection sensor detects an increase in the driving torque of the motor M1 so as to stop the motion of the second sandwiching member 503. With such a structure, the bundle of sheets S1 is firmly sandwiched by the first sandwiching member 502 and the second sandwiching member 503. The moving amount of the second sandwiching member 503 is measured by an encoder 509 and stored in a RAM. The measuring method of the thickness of a bundle of sheets S1 will be described later in detail.

At the stage when the bundle of sheets S1 is sandwiched by the first sandwiching member 502 and the second sandwiching member 503, a receiving plate 506 rotates 90 degrees and retreats, as shown in FIG. 4*b*. At the stage when the receiving plate retreats, the bottom surface SA of the bundle of sheets S1 and an applying roller 62 are not in contact with each other (refer to FIG. 4C).

Next, as shown in FIG. 4*d*, the adhesive applying unit 60 storing an adhesive 63 rises, then the applying roller 62 comes in contact with the bottom surface SA which will be the spine of the bundle of sheets S1, and the adhesive applying unit 60 moves along the bottom surface SA of the bundle of sheets S1. Thus, the adhesive 63 is applied on the bottom surface SA of the bundle of sheets S1. The applying roller 62 is driven by a motor M2.

Figure 5:
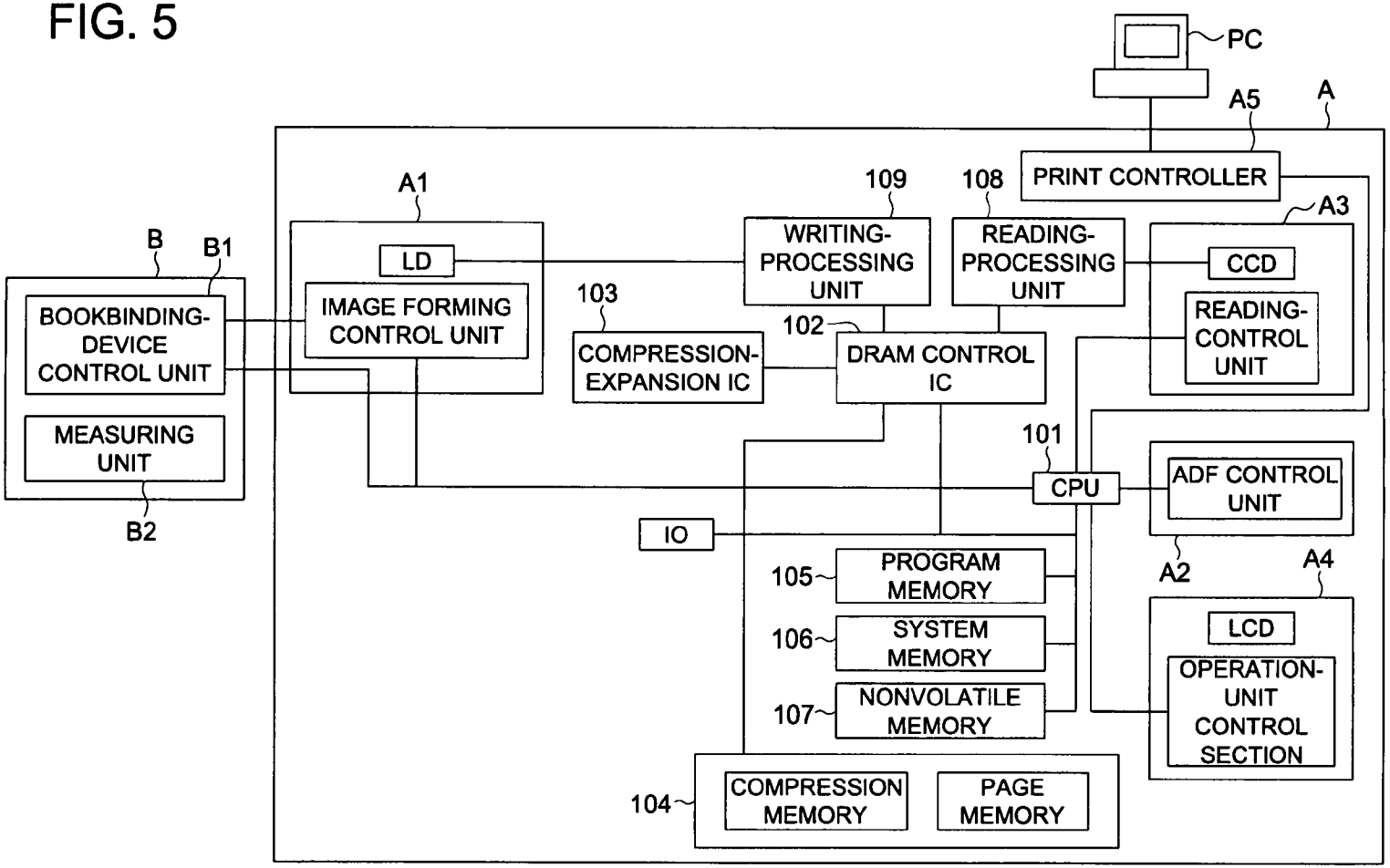
FIG. 5 is a block diagram of a control system in the image forming system.

FIG. 5 is a block diagram of a control system in the image forming system.

The image forming device A is connected with a PC, being a terminal such as a personal computer, and with the bookbinding device B. When image data is input from PC via a communication line, such as a LAN, to a print controller A5, a CPU 101 constructing a control unit in accordance with the invention controls a DRAM control IC 102 and compression-expansion IC 103 to store the image data in a compression memory in an image memory 104. On the other hand, if image data of an original document sheet read by a the image reading unit A3 is input, the image data is processed by a reading-processing unit 108 and stored in the compression memory likewise. In the case of forming an image on a sheet S1 or the like, based on stored image data, the compressed image data is expanded by the compression-expansion IC 103, and loaded in a page memory in the image memory 104. Then, CPU 101 controls an image forming control unit of the image forming unit A1, based on the image data loaded in the page memory, to form an image on the sheet S1 or the like. CPU 101 is connected with the image memory 104 as well as a program memory 105 that stores a program for execution of a series of operations in the image forming system, a system memory 106, and the like. A bookbinding-device control unit B1 of the bookbinding device B is connected with the image forming control unit of the image forming device A1 and executes bookbinding operation in relation with the image forming unit A1. Herein, CPU 101 being a control unit may be configured by plural CPUs and various operations of the image forming system may be executed by the plural CPUs. Thus, an integrated control unit may be implemented including plural CPUs.

Now, a method for setting bookbinding operation via the operation unit will be described, referring to FIGS. 6 to 9.

FIGS. 6 to 9 are detailed views of display screens of the operation unit A4.

Figure 1:
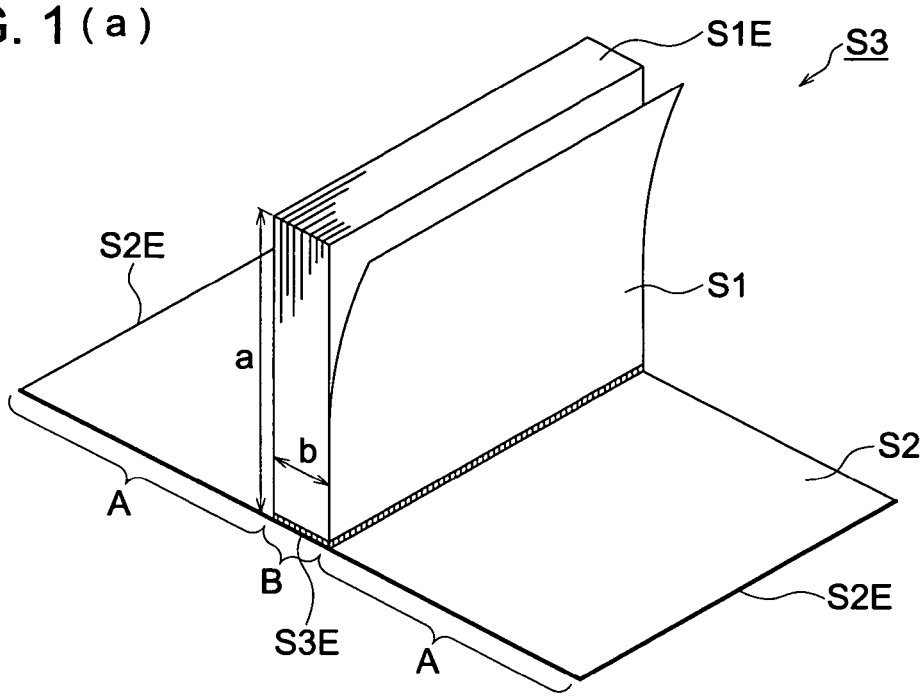
FIGS. 1*a* and 1*b* are detailed views of a wrapped book S3.
Figure 1:
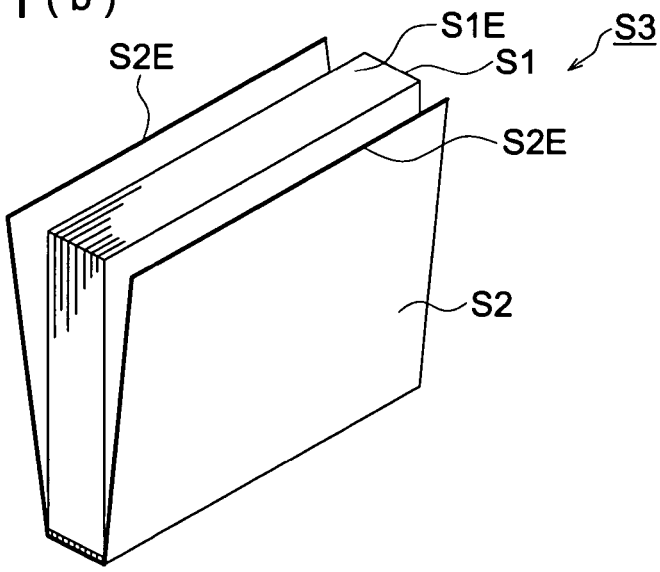
Figure 6:
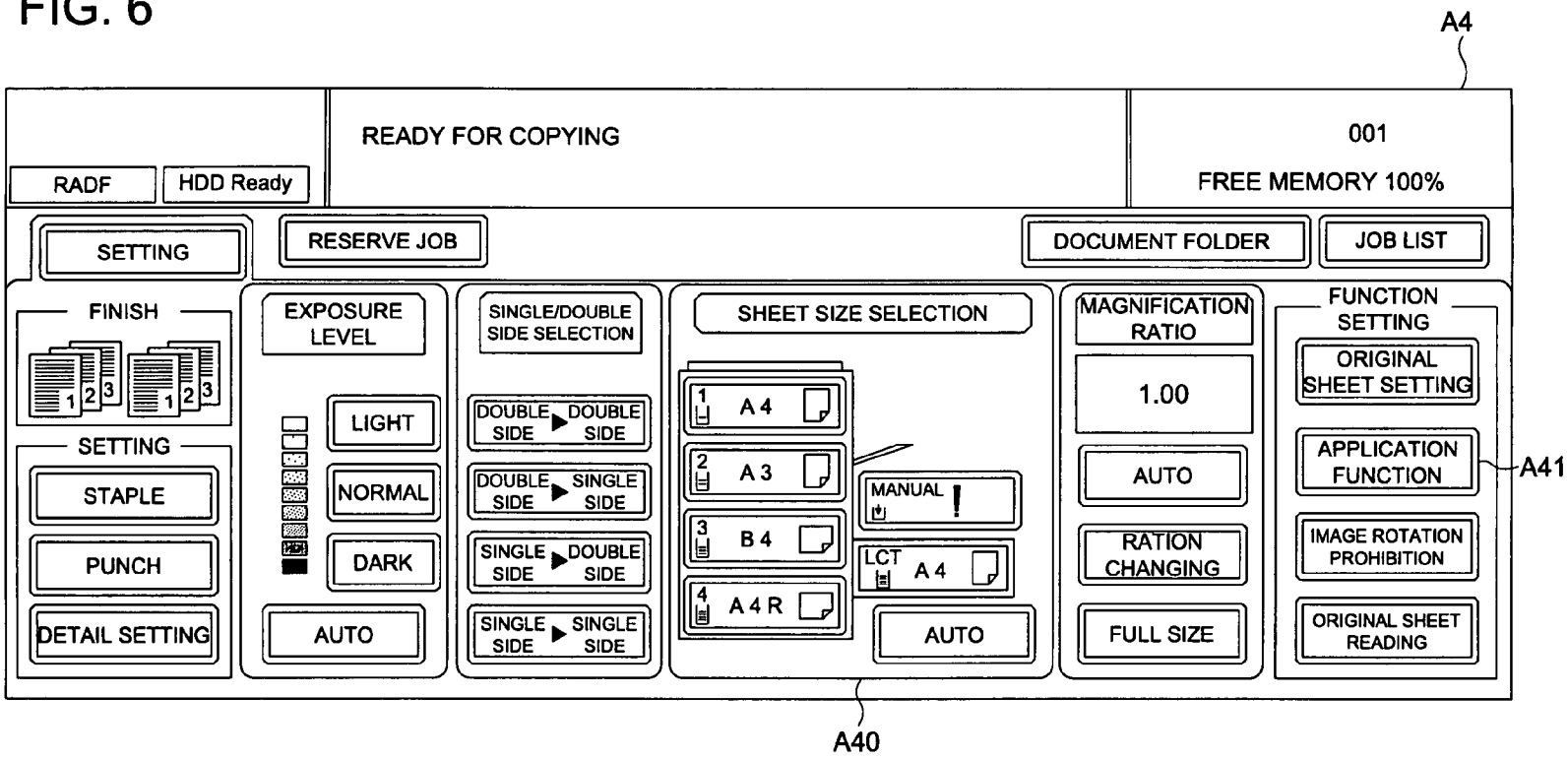
FIG. 6 is a detailed view of a display screen of an operation unit A4.
Figure 7:
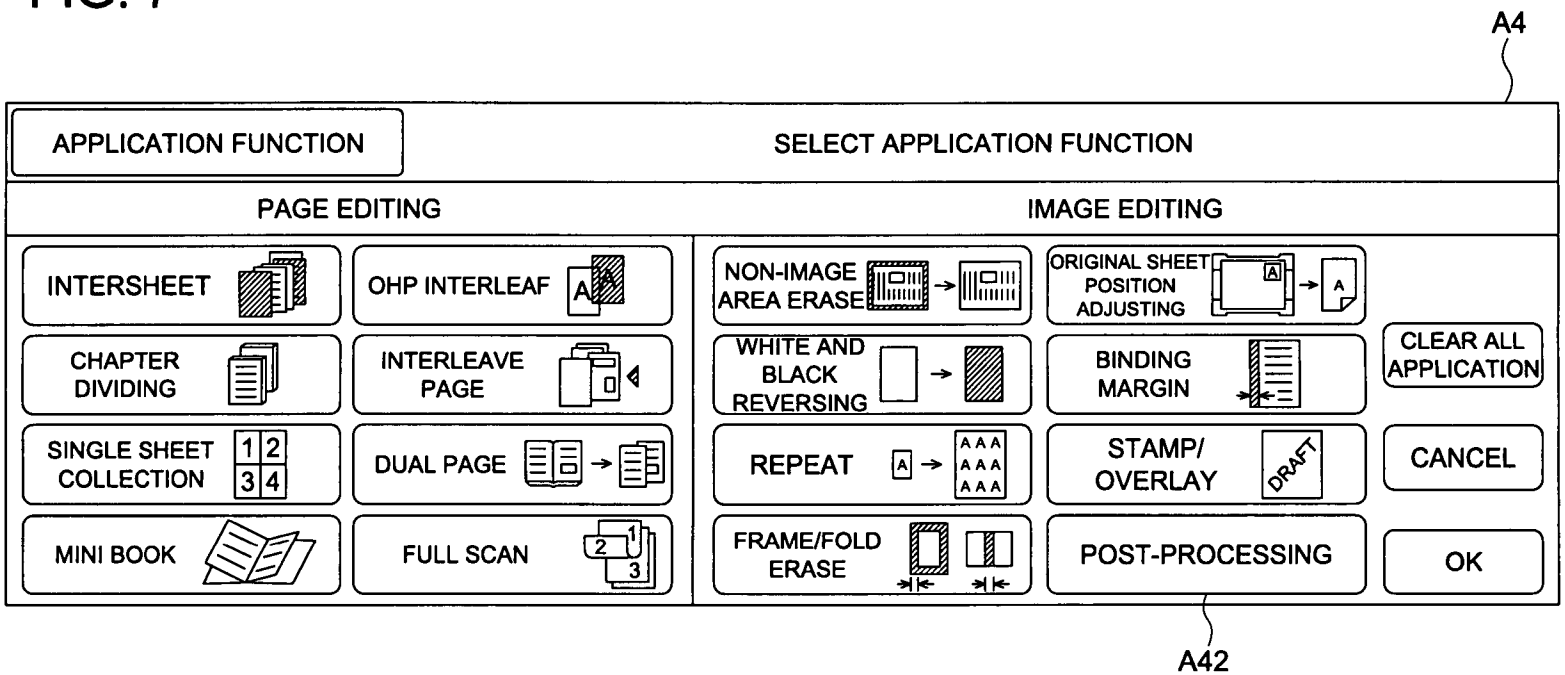
FIG. 7 is a detailed view of another display screen of the operation unit A4.
Figure 8:
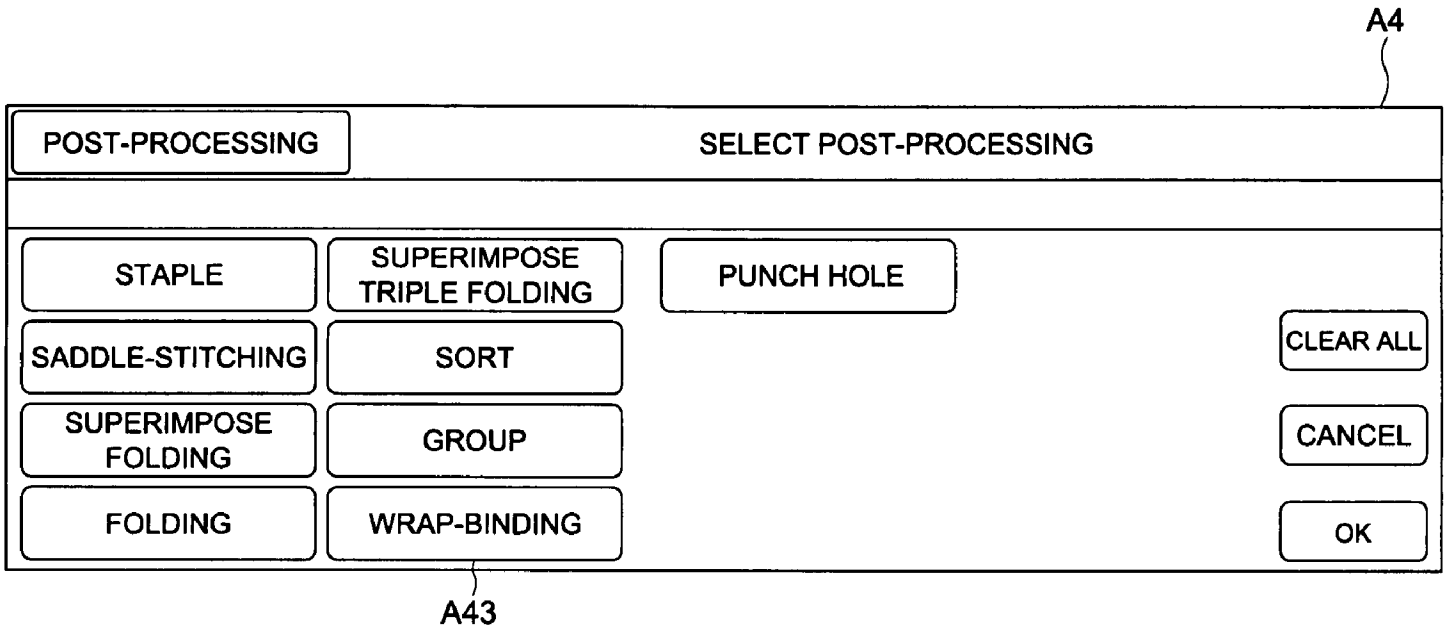
FIG. 8 is a detailed view of still another display screen of the operation unit A4.
Figure 9:
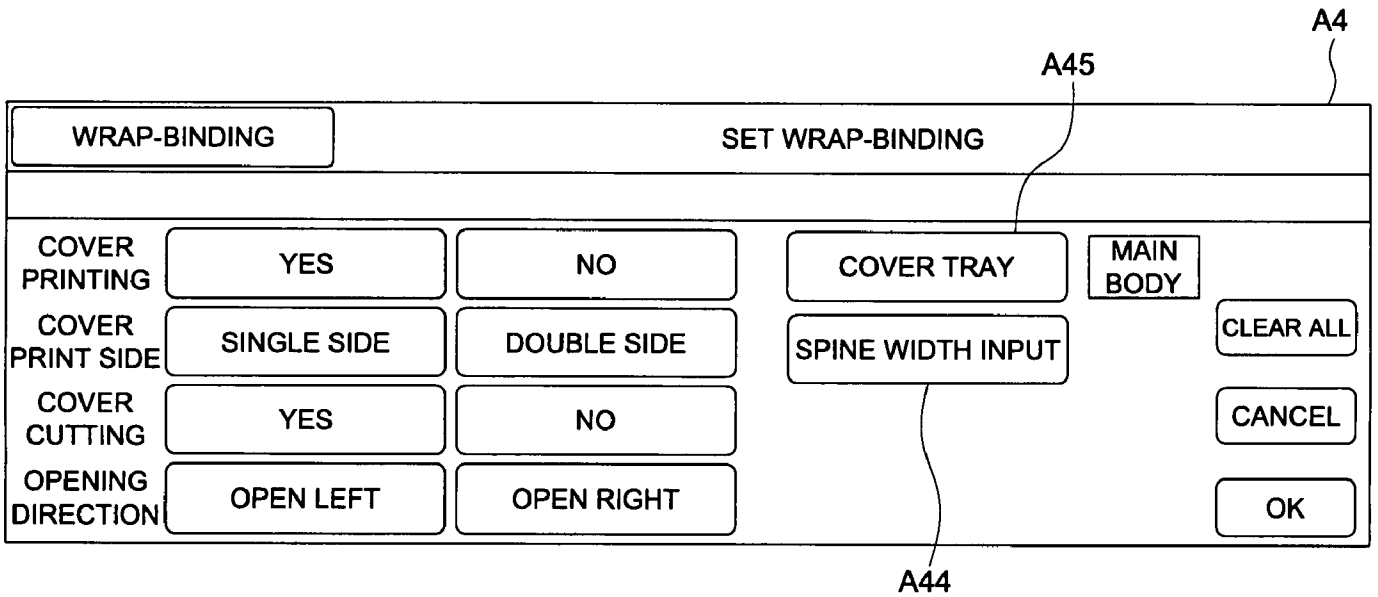
FIG. 9 is a detailed view of still another display screen of the operation unit A4.

FIG. 6 shows a basic screen, of the operation unit A4 having a selection section and input section. For selection of a sheet S1 to output, a sheet S1 is selected by pressing one of the buttons in the sheet size selection area A40. For execution of a bookbinding output, the application function button A41 is to be pressed first. When the application function button A41 is pressed, a setting screen related to application functions is displayed, as shown in FIG. 7, and then the post-processing button A42 is to be pressed on the setting screen. When the post-processing button A42 is pressed, a setting screen related to post-processing is displayed, as shown in FIG. 8. In a case where the user intends to execute a bookbinding output, wrapping sheets S1 with a cover S2 in a square-shape, as shown in FIGS. 1*a* and 1*b*, the user presses the wrap-bookbinding button A43 on the setting screen. When the wrap-bookbinding button A43 is pressed, a setting screen related to setting of wrap-binding is displayed, as shown in FIG. 9, on which to set printing or not-printing on a cover; printing side of the cover; cutting or not-cutting of the cover, and the like. By pressing the cover tray button A45, selection is made as to whether a cover S2 the user intends to use is stored in the image forming device main body or in the bookbinding device, and thus the cover S2 is selected. By pressing OK button, setting is completed.

Figure 2:
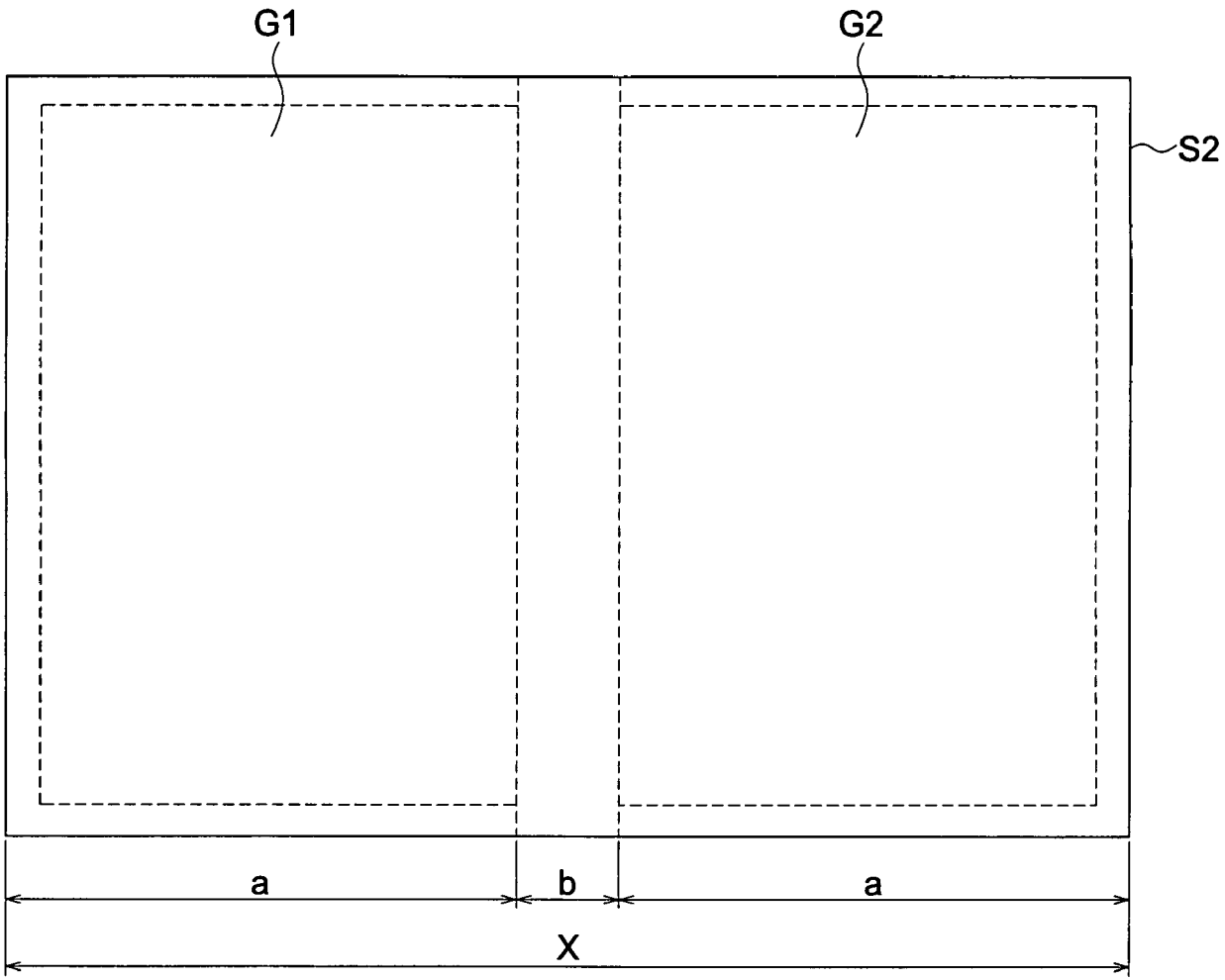
FIG. 2 is a development view of a cover S2.

As described, referring to FIG. 2, the value obtained as a sum of twice the length 'a' of a sheet S1 and the spine width 'b' is equal to the length X of a cover S2, the side edge S1E of sheets S1 and the side edges SE2 of a cover S2 will be aligned with each other, as shown in FIG. 1*b*. Accordingly, when the user selects a sheet S1 and the like via the operation unit A4 and the expression 'X=2a+b' is satisfied, an optimum wrapped book S3 will be output. If it is determined that the expression 'X=2a+b' is not satisfied upon selection of sheet S1 and the like prior to bookbinding output, it can be determined that the side edge S1E of sheets S1 and the side edges SE2 of a cover S2 will not be aligned with each other. So, the control unit preferably issues a warning notifying of this situation.

However, since size information is stored in the image forming device on the lengths X of covers S2 and the lengths 'a' of sheets S1, exact values can be obtained upon selection of a sheet S1 and the like via the operation panel. However, since the spine width 'b' changes with the thickness of the bundle of sheets S1, an exact value of the spine width 'b' cannot be obtained upon selection of a sheet S1 and the like. Consequently, a wasteful bookbinding output may be executed, if it is determined that the expression 'X=2a+b' is satisfied, with spine width value 'b' only as an approximate value, before starting a bookbinding output; a warning is issued notifying that the side edge S1E of sheets S1 and the side edges SE2 of a cover S2 will not be aligned with each other in a finished form of a wrapped book S3; and no more steps are taken. Therefore, the control unit preferably issues a warning at the time the spine width 'b' is accurately determined.

Herein, apparently as shown in FIGS. 1*a*, 1*b* and 2, the length 'a' of a sheet S1 is the length from the edge, corresponding to a spine S3E of a wrapped book form having a square-shape with a cover S2, to the side edge S1E, corresponding to the fore edge. The length X of the cover S2 is the total length from one of the two side edges S2E that form the fore edge of the wrapped form to the other one of the two side edges.

The warning operation in a bookbinding output will be described below.

First, the operation to measure the thickness of a bundle of sheets S1 for decision of a spine width 'b' will be described, referring to FIGS. 10 and 11.

Figure 10:
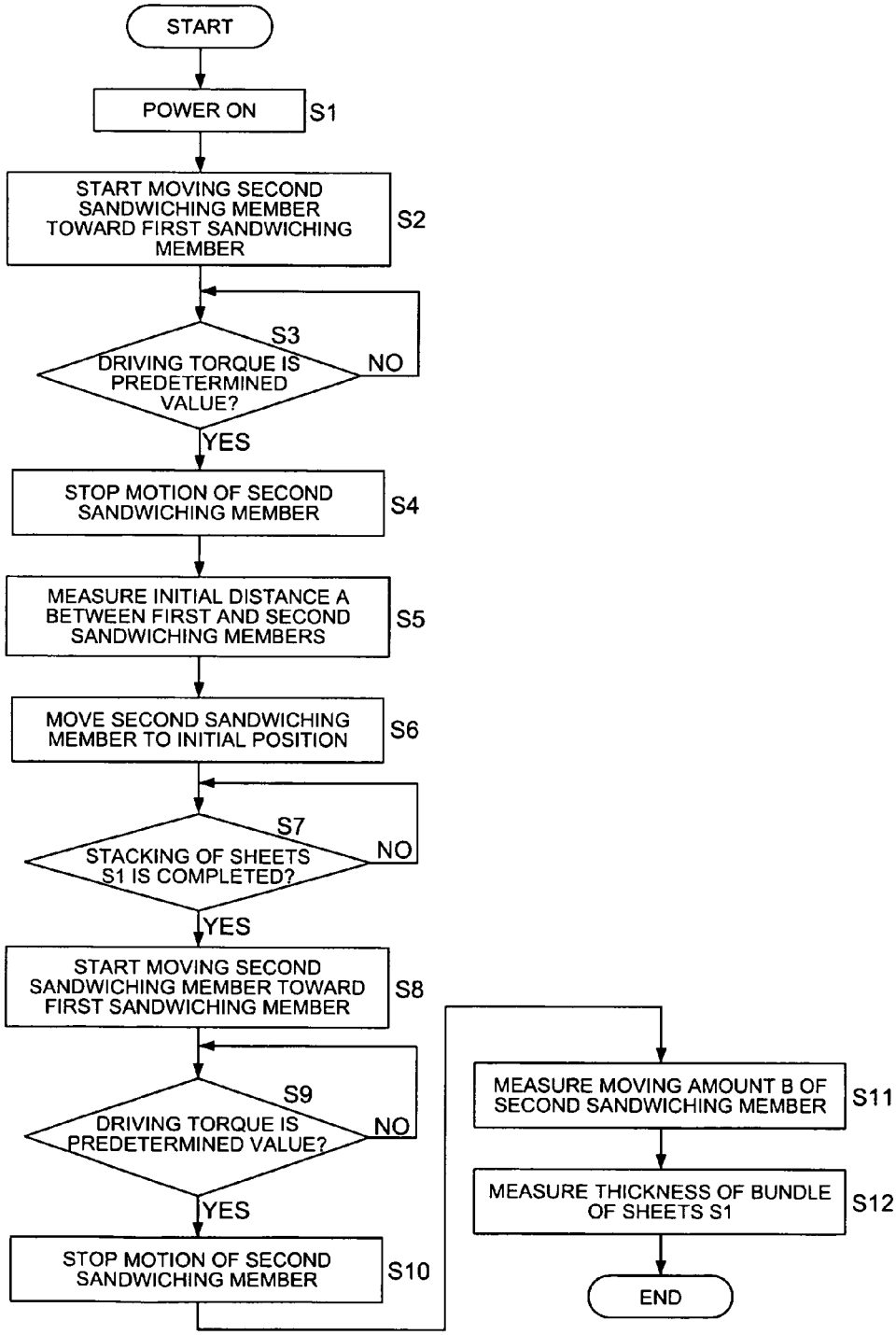
FIG. 10 is a flowchart showing the operation of measuring the thickness of the stack of sheets S1.
Figure 11:
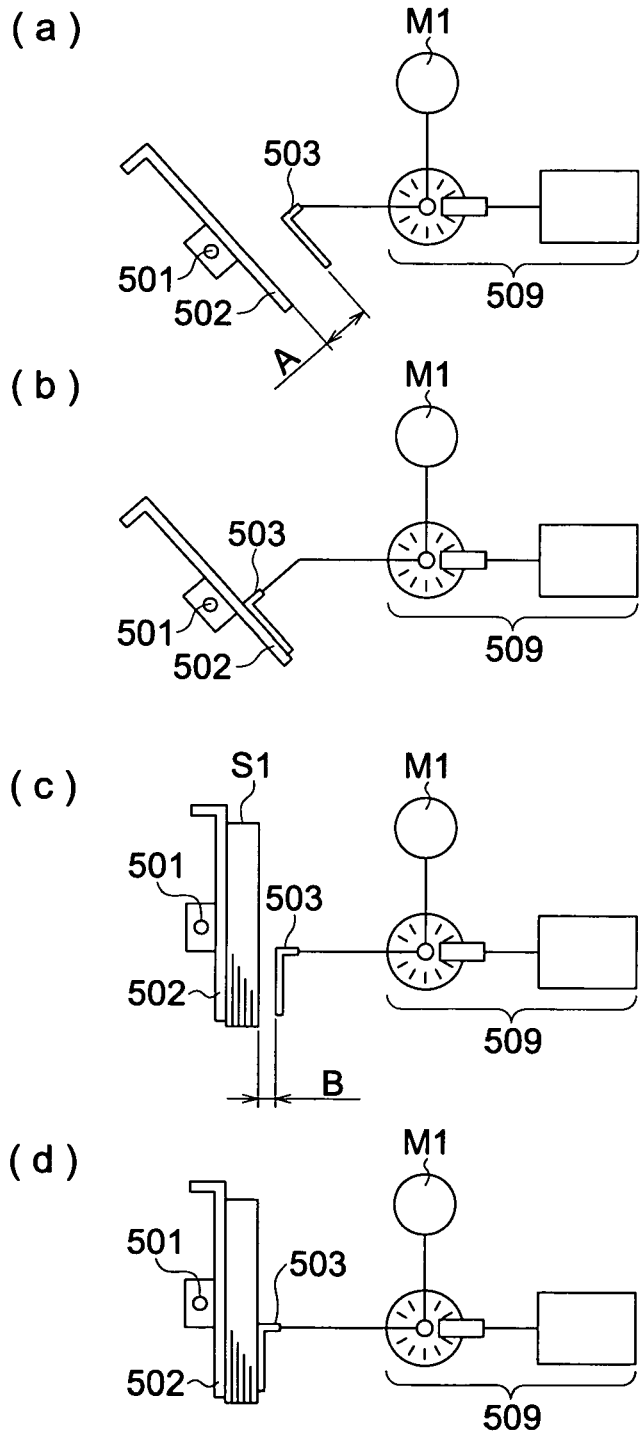
FIG. 11 is a diagram showing the operation of a first sandwiching plate 502 and a second sandwiching plate 503.

FIG. 10 is a flowchart showing the operation to measure the thickness of a bundle of sheets S1, and FIG. 11 is illustration related to the operation of the first sandwiching member 502 and the second sandwiching member 503. For a better understanding of the measuring method, members that are not necessary for understanding of the method are omitted in FIG. 11.

FIG. 11*a* shows a state where sheets S1 are not stacked between the first sandwiching member 502 and the second sandwiching member 503, and the sandwiching members are inclined. Herein, the second sandwiching member 503 is positioned at an initial position. In this state, measurement of the initial distance A between the first sandwiching member 502 and the second sandwiching member 503 is executed. When power is turned on for the bookbinding device B and the like in the image forming system (S1 in FIG. 10), a program to measure the initial distance A is read from the program memory 105 so that CPU 101 executes measuring operation. CPU 101 runs the motor M1 to move the second sandwiching member 503 toward the first sandwiching member 502 (S2 in FIG. 10), and then detects whether the driving torque of the motor M1 has reached a predetermined value with a driving torque detection sensor, not shown (S3 in FIG. 10). When CPU 101 has recognized that the driving torque of the motor M1 has reached the predetermined value, CPU 101 stops the motion of the second sandwiching member 503 (S4 in FIG. 10). When the motion of the second sandwiching member 503 is stopped, the first sandwiching member 502 and the second sandwiching member 503 are in a state of a contact with each other, as shown in FIG. 11*b*. The moving amount of the second sandwiching member 503 is measured by an encoder 509, and accordingly this moving amount is the initial distance A between the first sandwiching member 502 and the second sandwiching member 503 (S5 in FIG. 10). The measured initial distance A is stored in a system memory 106. When measurement of the initial distance A is completed, the second sandwiching member 503 is moved to the initial position so as to stack the sheets S1 (S6 in FIG. 10). Then, when stacking of the sheets S1 is completed (S7 in FIG. 10), rotation is made around a shaft 501, and the first sandwiching member 502 and the second sandwiching member 503 turn from the inclining state into the vertical state while keeping the initial distance A. The thickness of the stack of sheets S1 is measured by a measuring unit B2 of the bookbinding device B. The measuring unit B2 includes the first sandwiching member 502, second sandwiching member 503, motor M1, driving torque detection sensor, and above-described encoder 509 for detection of the moving amount of the second sandwiching member 503. First, the second sandwiching member 503 is moved toward the first sandwiching member 502 (S8 in FIG. 10), and the driving torque detection sensor detects whether the driving torque of the motor M1 has reached a predetermined value (S9 in FIG. 10). When it is detected that the driving torque of the motor M1 has reached the predetermined value, the motion of the second sandwiching member 503 is stopped (S10 in FIG. 10). When the motion of the second sandwiching member 503 is stopped, the second sandwiching member 503 and sheets S1 are in contact with each other, as shown in FIG. 11*d*. The moving amount of the second sandwiching member 503 (B in FIG. 11*c*) is measured by the encoder 509 (S11 in FIG. 10). Then, the initial distance A having been already measured is read from the system memory 106, and the thickness of the stack of sheets S1 is calculated by subtracting the moving amount B from the initial distance A (S12 in FIG. 10). Although the measuring method, shown in FIG. 11, measures the thickness of the stack of sheets S1 by moving the second sandwiching member 503 with the motor M1, it is not limited thereto, and the thickness may be measured by moving the first sandwiching member 502 instead of moving the second sandwiching member 503. The thickness of the stack of sheets S1 may also be measured by connecting both the first sandwiching member 502 and the second sandwiching member 503, with a motor and encoder, and moving the both sandwiching members.

By the measuring method described above, referring to FIG. 10 and FIG. 11, it is possible to obtain the actual thickness of a stack of sheets S1, which can be applied to the spine width 'b'. Thus, at this moment, it can be accurately determined as to whether the expression 'X=2a+b' is satisfied. If the expression 'X=2a+b' is not satisfied as a result, it is possible to issue a warning with notification that the side edge S1E of sheets S1 and the side edges S2E of a cover S2 will not be aligned with each other in a finished form of a wrapped book S3, enabling prevention of a wasteful bookbinding output. However, the timing of measuring the thickness of sheets S1 is at the time the when sheets S1 have been stacked on the stacking unit 50, namely, after starting bookbinding operation. Therefore, it is desirable to issue a warning to the possible extent before starting a bookbinding output.

In the following, a first warning mode that makes determination for a warning when a sheet S1 and the like are selected, and a second warning mode that makes determination for a warning when the thickness of the sheets S1 is measured, will be described, referring to a first and second embodiment.

First Embodiment

Figure 12:
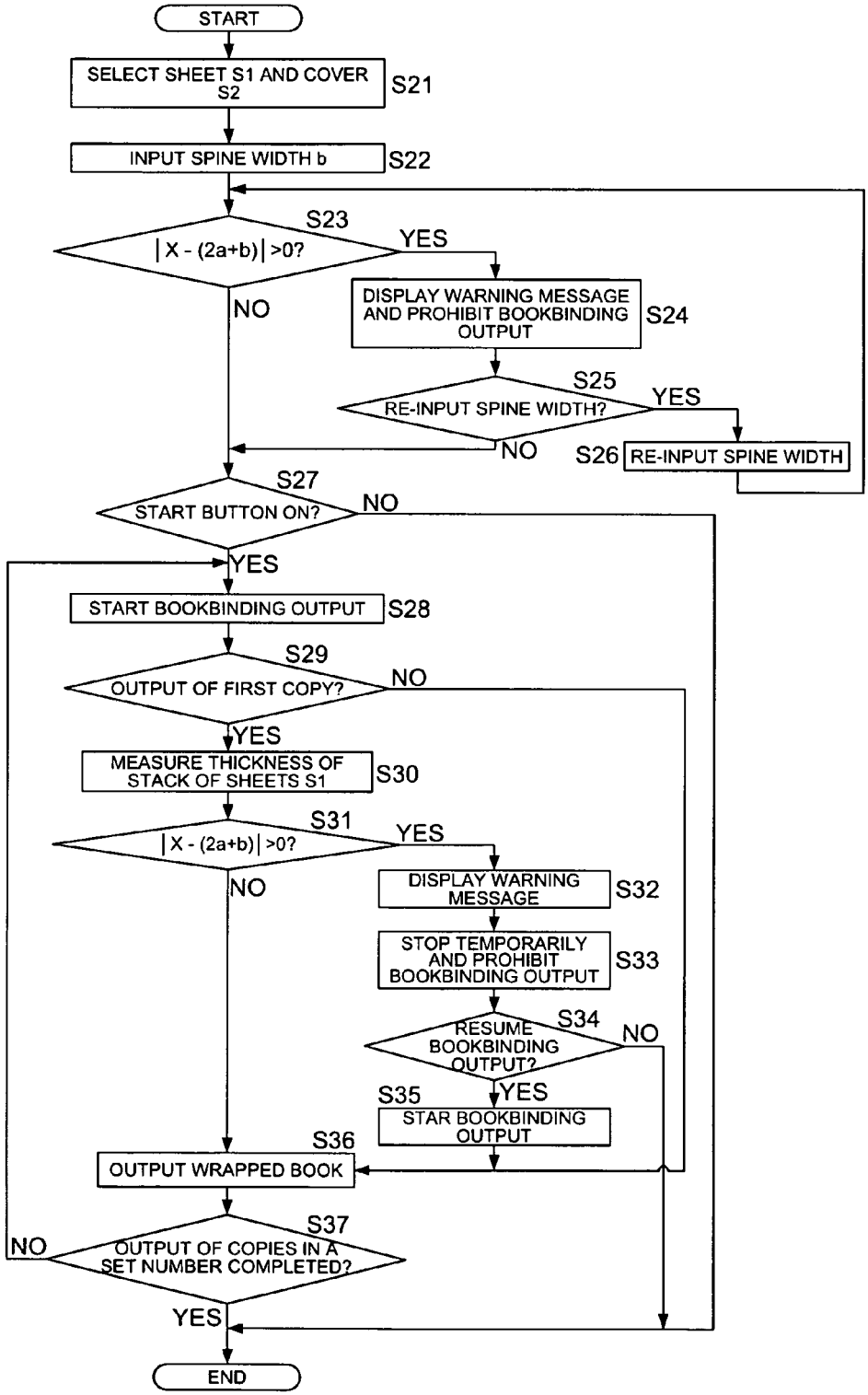
FIG. 12 is a flowchart showing warning operation of a case of inputting a spine width 'b' via the operation unit A4.

In the first embodiment, determination is made for a warning when a spine width 'b' is set by an input without cutting a cover S2 with the cutter 81. FIG. 12 is a flowchart showing the warning operation in a case of setting a spine width 'b' by an input via the input section of the operation unit A4.

A program to determine a warning in the image forming system is stored in the program memory 105, and CPU 101 controls respective units, based on the program. First, the first warning mode from S21 to S27 will be described. First, a sheet S1 and cover S2 are selected via the operation unit A4 (S21). The sizes of sheets S1 and covers S2 are stored in a nonvolatile memory 107. When a sheet S1 and cover S2 are selected via the operation unit A4, the length 'a' of the sheet S1 and the length X of the cover S2 are read from the nonvolatile memory 107. Then, a spine width 'b' is input via the operation unit A4 on the setting screen (S22) by pressing the spine width input section A44, shown in FIG. 9, and inputting a concrete spine width (1 to 30 mm, for example) via the operation unit A4. When the operation in S21 and S22 is completed, CPU 101 calculates the difference between X and (2a+b) by the use of the length 'a' of the sheet S1, length X of the cover S2, and the spine width 'b' having been input, and determines whether the following expression (1) is satisfied (S23).

$$|X-(2a+b)|>0 \quad (1)$$

If the expression (1) is not satisfied, it can be determined at this moment that the side edge S1E of the sheets S1 and the side edges S2E of the cover S2 will be aligned with each other in a finished form of a wrapped book S3, and accordingly a warning message is not displayed. If the expression (1) is satisfied, it can be determined at this moment that the side edge S1E of the sheets S1 and the side edges S2E of the cover S2 will not be aligned with each other in a finished form of a wrapped book S3, and accordingly a warning message is displayed on the operation unit A4 (S24). In this manner, CPU 101 prohibits bookbinding output by the image forming device A. If the value of (X−(2a+b)) is minus related to the expression (1), the distance between a side edge S2E of the cover S2 and the spine is shorter than that between the side edge S1E of the sheets S1 and the spine. Therefore, a warning message 'The cover for wrap-binding is too short.' is output on the operation unit A4 (S24). If the value of (X−(2a+b)) is plus, the distance between a side edge S2E of the cover S2 and the spine is longer than that between the side edge S1E of the sheets S1 and the spine. Therefore, a warning message 'The cover for wrap-binding is too long.' is output on the operation unit A4 (S24). Prohibiting of bookbinding output by the image forming device A is executed for re-input of a spine width, which will be described referring to S26. In addition to displaying this warning message, a screen for selection as to whether a spine width is to be re-input or not is displayed on the operation unit A4, thereby letting the user select as to whether the user re-inputs a spine width or not (S25). In such a manner, it is possible to notify the user that the bookbinding output can be properly executed if the user re-inputs a spine width. If a selection is made for not re-inputting a spine width, then it is judged whether the start button for starting bookbinding output is pressed or not (S27). If re-input of a spine width is selected, the setting screen, shown in FIG. 9, is displayed again. If a spine width is re-input (S26), then it is determined again whether the expression (1) is satisfied or not. Herein, when a warning message is displayed, the screen for selection as to whether a spine width is to be re-input or not is displayed on the operation unit A4, as described above. However, CPU 101 may prohibits image forming in such a manner that image forming cannot be executed in the image forming device A unless a spine width is re-input, and further, control may be performed such that, in a case where a spine width is not re-input even after a certain time has elapsed, the user clears the contents having been set via the operation unit A4 to terminate the operation.

Next, the second warning mode from S28 to S36 will be described. If the start button is pressed to start bookbinding output (S28), then it is determined whether the currently executed bookbinding output is an output of the first copy (S29). If it is determined to be operation related to the output of the first copy, the thickness of the stack of sheets S1 is measured (S30). The measuring method is one described above, referring to FIG. 10 and FIG. 11. Then, applying the measured thickness of the stack of sheets S1 to the spine width 'b', it is re-determined whether the above expression (1) is satisfied or not (S31). The lengths X and 'a' used for this determination are the same as those used in S23. If the expression (1) is not satisfied in S31, it can be determined that the side edge S1E of sheets S1 and the side edges S2E of a cover S2 will be aligned with each other for a wrapped book S3 to be output actually; therefore, a warning message is not output and a wrapped book is output (S36); and the steps from S28 to S37 are repeated until the output of copies in a set number is completed. On the other hand, if the expression (1) is satisfied, it can be determined that the side edge S1E of sheets S1 and the side edges S2E of a cover S2 will not be aligned with each other for a wrapped book S3 to be output actually, and accordingly, a warning message is output (S32), and bookbinding is stopped temporarily and prohibited (S33). The warning message displayed in S32 is the same as one displayed in S24. In the temporary stoppage in S33, control may be performed such that CPU 101 temporarily stops bookbinding output after outputting the stack of sheets S1 of which thickness having been measured and prohibits image forming for the next stack of sheets. By this control, the stack of sheets having been measured will not remain in the image forming system. Further, the measured stack of sheets may be output without wrapping in a square-shape with the cover S2, thus enabling quick output of the stack of sheets. Still further, the temporary stop in S33 may be omitted by setting via the setting screen on the operation unit A4. In addition to displaying a warning message, a screen is displayed on the operation unit A4 to select whether to resume bookbinding output, thereby letting the user select whether or not to resume bookbinding output (S34). If resumption of bookbinding output is selected, then bookbinding output resumes (S35), a wrapped book is output (S36), and the operation from S28 to S37 is repeated until the flow of output of copies in a set number is completed. In a case of not resuming bookbinding output, subsequent bookbinding output is halted.

As described above, by an input of a spine width and an issuance of a warning, based on the input value, it is possible to notify the user whether or not a proper bookbinding output will be achieved at an early stage to the possible extent, and to let the user determine whether or not to execute bookbinding output. Further, by actually measuring the thickness of the stack of sheets S1 and issuing a warning at the time the spine width is accurately recognized, it is possible to notify the user whether a proper bookbinding output will be executed with high accuracy, which prevents wasteful bookbinding output.

Although in the present embodiment, a structure has been described, where a warning is issued either when the value of 'X−(2a+b)' is greater or when the value is smaller, than a predetermined value, it is also possible to issue a warning in one of a case where the value is greater than the predetermined value and a case where the value is smaller than the predetermined value. For example, in a situation where cutting is executed after bookbinding, it is possible to issue a warning only in a case where the value of 'X−(2a+b)' is smaller than the predetermined value, and to execute bookbinding and make the side edge of the bundle of sheets and the side edges of the cover aligned with each other by cutting the side edges after bookbinding in a case where the value of 'X−(2a+b)' is greater than the predetermined value.

Further, in the present embodiment, a structure has been described which is particularly suitable for a case where zero is adopted as the predetermined value to be compared with the value of 'X−(2a+b)' so as to achieve bookbinding of a book for which the side edge of the bundle of sheets and the side edges of a cover will be accurately aligned with each other. However, the predetermined value maybe properly and flexibly set, depending on the accuracy required for a wrapped book to be formed.

It has been described in the first embodiment about a case where selection of a sheet S1 and the like and input of a spine width 'b' are carried out via the operation unit A4 (S21 and S22), and original document sheets are read and copied by the image forming system. However, the same effects can be obtained also in an embodiment where selection of a sheet S1, etc. and input of a spine width 'b' are executed via a personal computer (PC) connected to the image forming device A, and the first warning mode and second warning mode, described above, are executed when image data transmitted from PC is printed by the image forming system, based on size information, such as the size of sheet S1 and the like, transmitted from a printer driver. That is, the operation may be arranged such that display of a warning message (S24 or S32) is executed on PC, and re-input of a spine width (S26) and selection as to resume bookbinding output or not (S34) are executed by the user on PC. Further, the same effects can be obtained, not only by an image forming system having both copying and printing functions, but also by an image forming system having only one of copying and printing functions that executes the first warning mode and second warning mode, described above.

Second Embodiment

Figure 13:
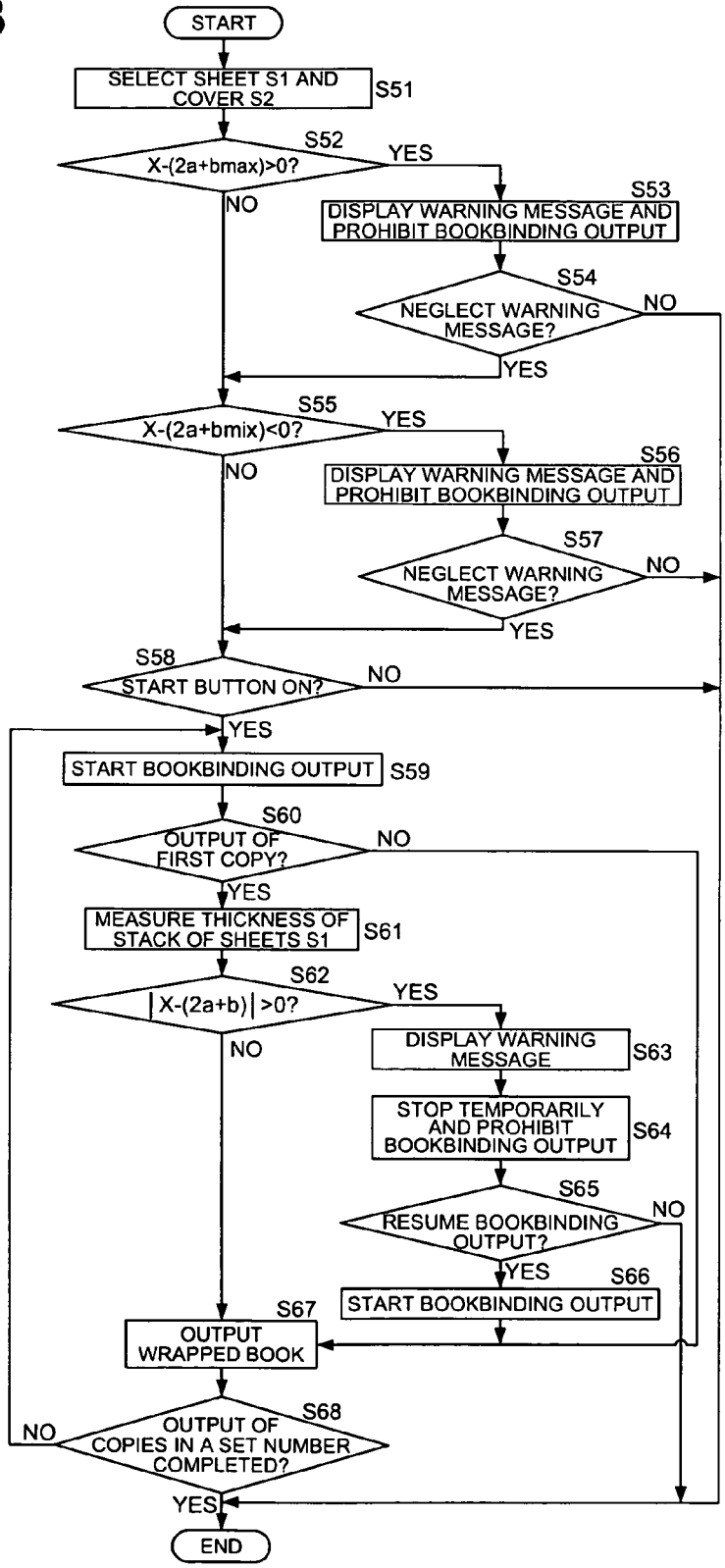
FIG. 13 is a flowchart showing warning operation of a case of using a maximum spine width and a minimum spine width.

In a second embodiment, a cover S2 is not cut with a cutter 81, and a warning is issued by the use of predetermined values of a maximum spine width and minimum spine width of a wrapped book S3 formed by an image forming system. FIG. 13 is a flowchart showing a warning operation by the use of predetermined values of a maximum spine width and minimum spine width.

First, a first warning mode from S51 to S58 will be described. First, a sheet S1 and a cover S2 are selected via an operation unit A4 (S51). Same as described, referring to S21 in FIG. 12, sizes of sheets S1 and sizes of covers S2 are stored in a nonvolatile memory 107, and when selected via the operation unit A4, a length 'a' of a sheet S1 and a length X of a cover S2 are read from the nonvolatile memory 107. Next, applying, to the spine width, the maximum spine width bmax of a wrapped book to be formed by the image forming system, it is determined whether the below expression (2) is satisfied (S52). The maximum spine width bmax is stored in the nonvolatile memory 107 and is a value of 40 mm, for example. It is determined if the following expression (2) is satisfied with this value. If the expression (2) is satisfied, a warning is issued notifying that the distance between the spine and the side edges S2E of the cover S2 would be inevitably longer than that between the spine and the side edge S1E of the sheets S1E in a finished form of a wrapped book S3 if bookbinding output would be executed.

$$X-(2a+\text{bmax})>0 \quad (2)$$

A warning message is not displayed unless the expression (2) is satisfied. If the expression (2) is satisfied, a warning message 'The cover for wrap-binding is too long.' is displayed on the operation unit A4, and CPU 101 prohibits bookbinding output by the image forming device A (S53).

Prohibiting of bookbinding output by the image forming device A is executed in order to determine whether or not the warning message is to be neglected, which will be described in the following, referring to S54. In addition to displaying this warning message, a screen for selection as to whether bookbinding output is to be executed or not, in other words, whether this message is to be neglected or not, is displayed on the operation unit A4 so that the user can make selection (S54). If selection is made for not executing the start of bookbinding output, then the flow is terminated and bookbinding output is halted, and if selection is made for executing bookbinding output, then the process is moved to a step for determination on the expression (3) described below. It is determined whether the expression (3) is satisfied (S55) if the minimum spine width bmin of a wrapped book S3 to be formed by the image forming system is applied to the spine width. The minimum spine width bmin is stored in the non-volatile memory 107 and is a value of 1 mm, for example. It is determined whether the expression (3) is satisfied, applying this value. If the expression (3) is satisfied, a warning is issued notifying that the distance between the spine and the side edges S2E of the cover S2 would be shorter than that between the spine and the side edge S1E of the sheets S1 in a finished form of a wrapped book S3 if bookbinding output would be executed.

$$X-(2a+\text{bmin})<0 \quad (3)$$

If the expression (3) is not satisfied, a waning message is not displayed. If the expression (3) is satisfied, then a warning message 'The cover for wrap-binding is too short.' is displayed on the operation unit A4, and bookbinding output is prohibited (S56). S56 to S57 including display of the warning message execute the similar steps as to those in S53 to S54. When the start button is pressed, bookbinding output starts (S58).

The second warning mode in S59 to S67 is similar to the second warning mode in S28 to S36, as described above referring to FIG. 12, and accordingly description of the second warning mode is omitted here.

As it has been described, by issuing a warning, applying the maximum spine width bmax or the minimum spine width bmin to the spine width, it is possible to notify the user that the side edge S1E of sheets S1 and the side edges S2E of a cover S2 apparently will not be aligned with each other, thus preventing a wasteful bookbinding output. Further, if a warning is issued at the time an accurate spine width is determined by actually measuring the thickness of the stack of sheets S1, it is possible to notify the user whether proper bookbinding output will be executed with high accuracy, which prevents wasteful bookbinding output.

Also, in the present embodiment, a structure has been described where a warning is issued in both cases. That is, a warning is issued either when the value of the left-hand side of the expressions (2), namely the value of 'X−(2a+bmax)', is greater than a predetermined value, or when the value of the left-hand side of the expressions (3), namely the value of 'X−(2a+bmin)', is smaller than a predetermined value. However, it is also possible to issue a warning in one of a case where the value of the left-hand side of the expression (2) is greater than a predetermined value and a case where the value of the left-hand side of the expression (2) is smaller than a predetermined value, same as in the first embodiment.

Further, also in the present embodiment, as a predetermined value to be compared with the value of X−(2a+bmax) of the expression (2) and a predetermined value to be compared with the value of 'X−(2a+bmin)' of the expression (3), zero is adopted. However, predetermined values can be properly and flexibly set, same as in the first embodiment.

Still further, also in the present embodiment, same as in the first embodiment, the same effects can be obtained also in such a manner that the first warning mode or second warning mode, described above referring to FIG. 12, are executed when image data transmitted from a PC is printed by the image forming system. Further, the same effects can be obtained, not only by an image forming system having both copying and printing functions, but also by an image forming system having only one of copying and printing functions that executes the first warning mode and second warning mode, described above referring to FIG. 13.

Third Embodiment

In a third embodiment, a case where a cover S2 is cut with a cutter 81 will be described.

Figure 14:
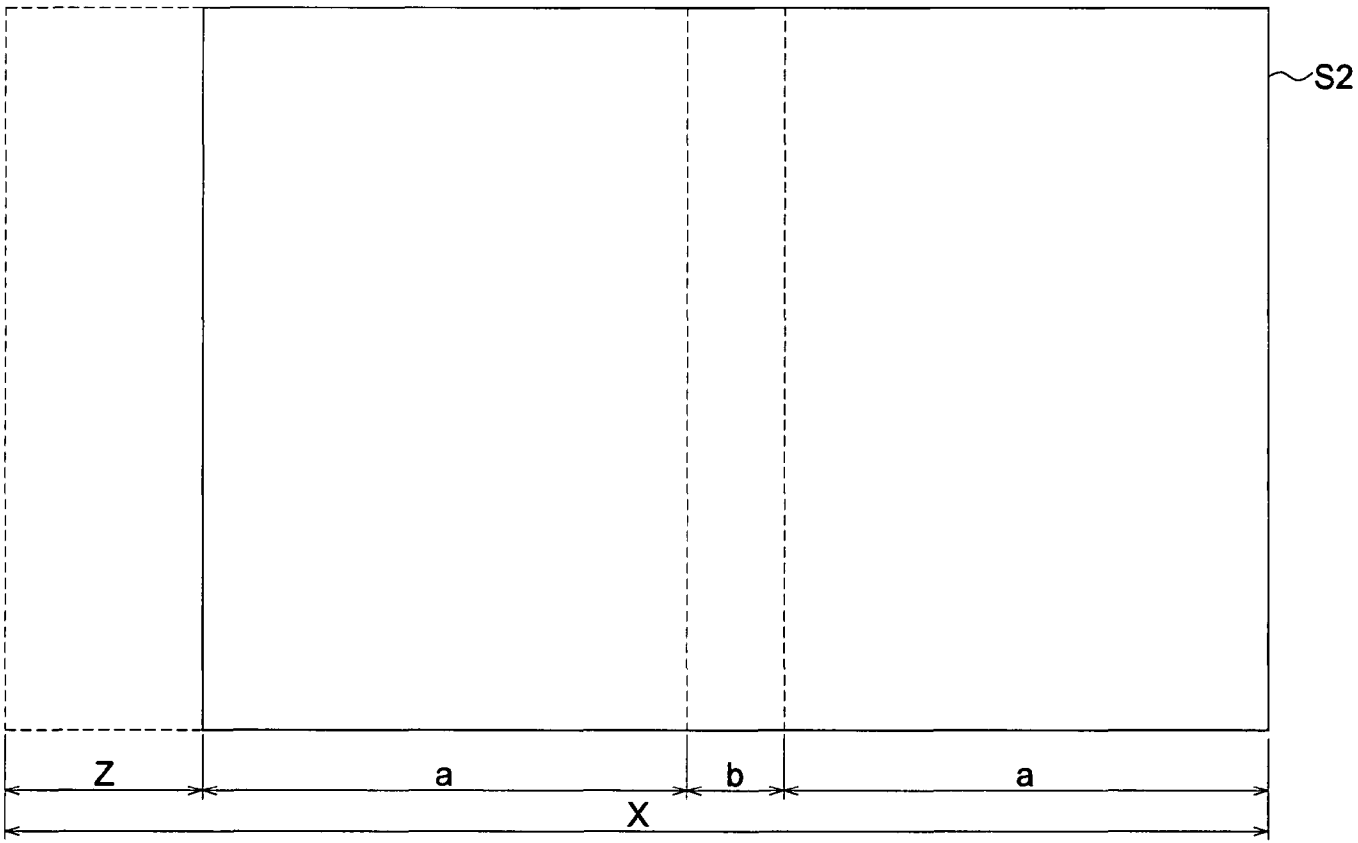
FIG. 14 is a development of a cover S2.

FIG. 14 is a development view of a cover S2.

The length of a cover before cutting is represented by X, and the cutting amount by the cutter 81 is represented by Z. In a case where a cover S2 is in a long unfixed length, the cover S2 is cut with the cutter 81, and the actual length of the cover S2 becomes 'X-Z'. Accordingly, for determination as to whether the edge S1E of sheets S1 and the edges S2E of the cover S2 will be aligned with each other in a finished form of a wrapped book S3, it is necessary to determine, based on the length (X-Z) after the cutting.

Figure 15:
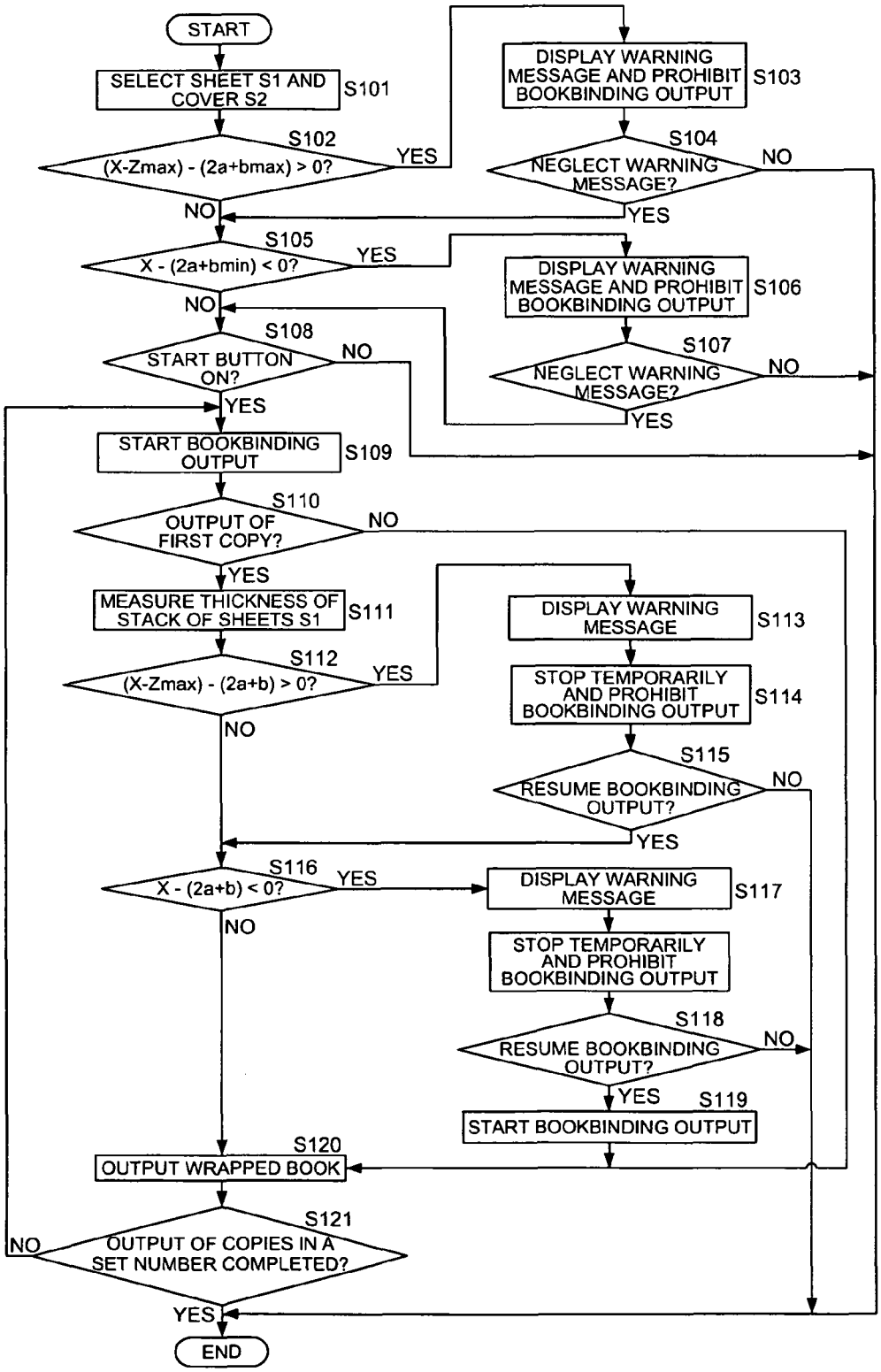
FIG. 15 is a flowchart showing warning operation of a case of using the maximum spine width and the minimum spine width, taking into account a cutting amount of the cover S2.

FIG. 15 is a flowchart showing a warning operation by the use of a maximum spine width and a minimum spine width, taking into account a cutting amount of a cover S2.

The flowchart shown in FIG. 15 is in approximation with the flowchart shown in FIG. 13. First, if compared with the first warning mode from S51 to S58 in FIG. 13, the first warning mode from S101 to S108 is different in that the length X of a cover S2 used in the expression (2) is replaced by X-Zmax, described referring to FIG. 14, (Zmax is the maximum value of a cutting amount Z in the image forming system, and is 40 m, for example.), and determination is made with the below expression (4). If determination is made with the expression (4), it is possible to notify the user whether proper bookbinding output will be executed with a cutting amount taken into account, which is preferable for an image forming system that executes bookbinding output by the use of a longer unfixed size for a cover S2.

$$(X-\text{Zmax})-(2a+\text{bmax})>0 \quad (4)$$

Further, if compared with the second warning mode from S59 to S67 in FIG. 13, the second warning mode from S109 to S120 is different in that the warning is issued in two steps. First, applying the measured thickness of the stack of sheets S1 to the spine width 'b', it is determined whether the following expression (5), which takes into account the cutting amount of a cover S2, is satisfied (S112).

$$(X-\text{Zmax})-(2a+b)>0 \quad (5)$$

If the expression (5) is not satisfied, a warning is not issued. If the expression (5) is satisfied, the distance between the spine and side edges S2E of the cover S2 inevitably becomes longer than that between the spine and the side edge S1E of the sheets S1. Accordingly, a warning 'The cover for wrap-binding is too long.' is displayed on the operation unit A4 (S113), and bookbinding output is stopped temporarily and prohibited (S114). In the temporary stoppage in S114, control may be performed such that CPU 101 temporarily stops bookbinding output after outputting the stack of sheets S1 of which thickness having been measured, and prohibits bookbinding output for the next stack of sheets. By this control, the stack of sheets having been measured does not remain in the image forming system. Further, the measured stack of sheets may be output without wrapping in a square-shape with the cover S2, thus enabling quick output of the stack of sheets. Still further, the temporary stop in S114 may be omitted by setting via the setting screen on the operation unit A4. In addition to displaying a warning message, a screen is displayed on the operation unit A4 to select whether to resume bookbinding output, thereby letting the user select whether or not to resume bookbinding output (S115). In case of resuming bookbinding output, the process moves according to a determination in S116.

In S116, it is determined whether the following expression (6) is satisfied, taking into account the length of the sheet S2 without cutting.

$$X-(2a+b)<0 \quad (6)$$

If the expression (6) is not satisfied, it can be determined that the side edge S1E of sheets S1 and the side edges S2E of cover S2 will be aligned with each other for a wrapped book S3 to be actually output, and accordingly no warning message is displayed. If the expression (6) is satisfied, thee distance between the spine and the side edges S2E of the cover S2 inevitably becomes shorter than the distance between the spine and the side edge S1E of the sheets S1, and accordingly a message 'The cover for wrap-binding is too short.' is displayed on the operation unit A4 (S117). In addition to displaying the warning message, a screen is displayed on the operation unit A4 to select whether to resume bookbinding output, thereby letting the user select whether or not to resume bookbinding output (S118). If resumption of bookbinding output is selected, then bookbinding output resumes (S119), a wrapped book is output (S120), and the operation from S109 to S121 repeats until the flow of output of copies in a set number is terminated and completed. In a case of not resuming bookbinding output, subsequent bookbinding output is halted.

Herein, in addition to the expression (6), it may be determined whether the following expression (7) is satisfied, taking into account the minimum value Zmin (3 mm, for example) of the cutting amount with the cutter 81.

$$(X-\mathrm{Zmin})-(2a+b)<0 \quad (7)$$

Similarly to the description with reference to FIG. 13, it has been described, with reference to FIG. 15, about the operation of issuing a warning by the use of a value of the maximum spine width or the minimum spine width of a wrapped book S3 to be formed by the image forming system, the same as shown in FIG. 13. However, operation of issuing a warning by inputting a spine width 'b' is also possible.

As has been described, even with an image forming system that executes bookbinding output by the use of a longer unfixed size for a cover S2, it is possible to notify the user that the side edge S1E of sheets S1 and the side edges S2E of a cover S2 apparently would not be aligned with each other, taking into account the cutting amount. Thus, wasteful bookbinding output can be prevented. Further, by issuing a warning at the time the thickness of the stack of sheets S1 is actually measured and an accurate spine width is determined, it is possible to notify the user whether proper bookbinding output will be executed with high accuracy, which prevents wasteful bookbinding output.

In the present embodiment also, zero is applied to the predetermined values to be compared with the left-hand side of the expressions (3) to (7). However, the predetermined values can be properly and flexibly set, the same as in the first embodiment.

Still further, also in the present embodiment, the same as in the first embodiment, the same effects can be obtained also in such a manner that the first warning mode and second warning mode, described above referring to FIG. 12, are executed when image data transmitted from a PC is printed by the image forming system. Further, the same effects can be obtained, not only by an image forming system having both copying and printing functions, but also by an image forming system having only one of copying and printing functions that executes the first warning mode and second warning mode described above referring to FIG. 12.

Fourth Embodiment

Figure 16:
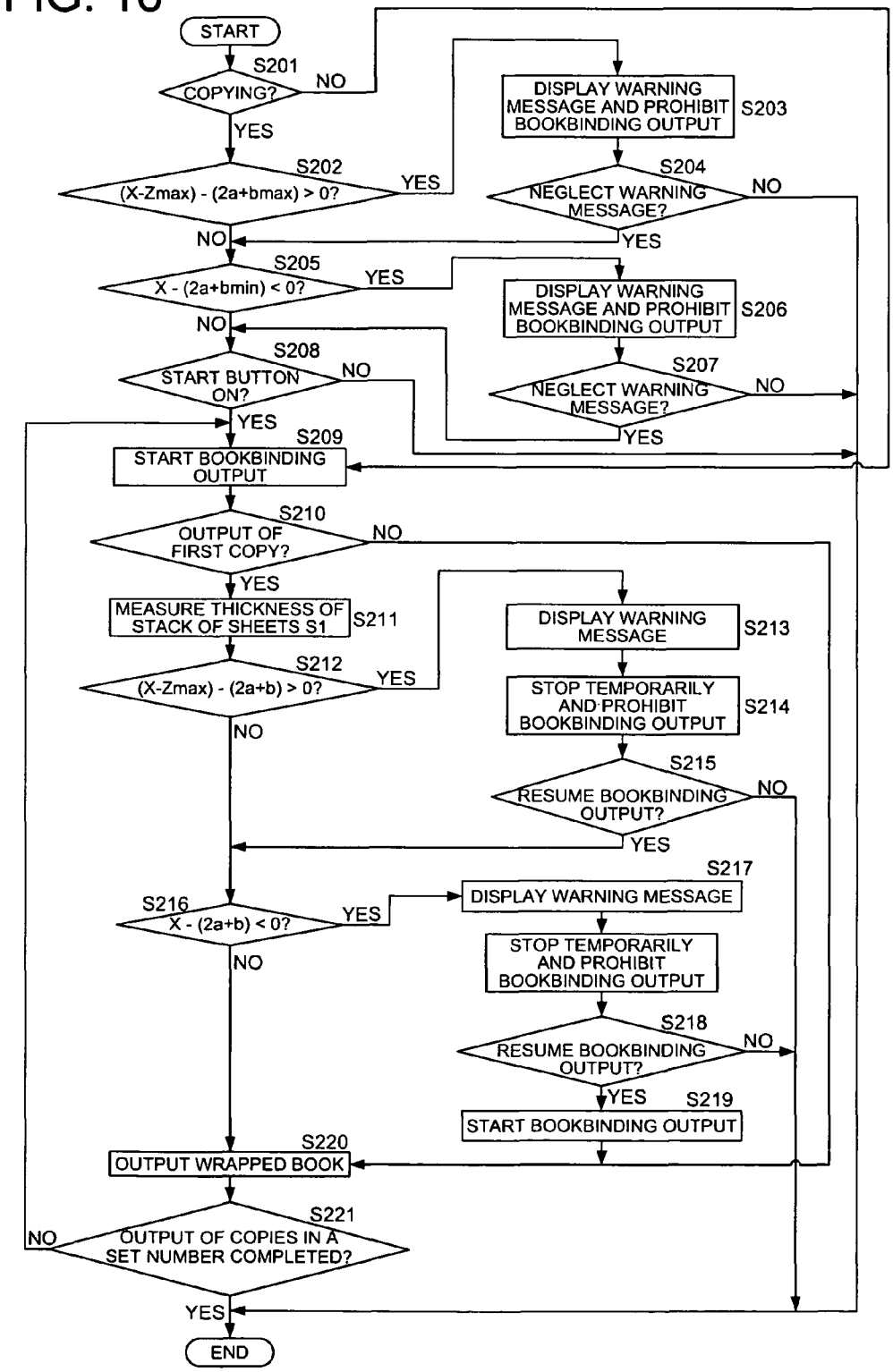
FIG. 16 is a flowchart showing different warning operations between copying operation and printing operation.

In a fourth embodiment, different warning operations are executed between copying operation and printing operation in an image forming system. FIG. 16 is a flowchart showing the different warning operations between copying operation and printing operation.

The flowchart shown in FIG. 16 is in approximation with the flowchart shown in FIG. 15. First, in S201, it is determined whether image forming to be executed by the image forming device A is copying of original document sheets or printing of received image data. When a sheet S1 and cover S2 are selected via the operation unit A4 and if the start button is pressed, the image forming is determined to be copying of an original document sheet, and if a printing job is received, the image forming is determined to be printing. If the image forming is determined to be copying of original document sheets in S201, the first warning mode from S202 to S208 and the second warning mode from S209 to S220 are executed. The first warning mode from S202 to S208 is the same as the first warning mode from S102 to S108 in FIG. 15, and the second warning mode from S209 to S220 is the same as the second warning mode from S109 to S120 in FIG. 15. Accordingly, description of the first and second warning modes is omitted here. On the other hand, in S201, if the image forming is determined not to be copying of original document sheets, in other words, determined to be printing of received image data, the first warning mode from S202 to S208 is not executed; the process is moved to S209; and the second warning mode from S209 to S220 is executed. Herein, in the second warning mode in copying original document sheets, display of a warning message (S213 and S217) and selection (S215 and S218) whether to resume bookbinding output are executed on the operation unit A4. In the second warning mode in printing of received image data, display of a warning message (S213 and S217) and selection (S215 and S218) whether to resume bookbinding output are executed on a PC.

As described above, control may be performed such that both the first warning mode and the second warning mode are executed in copying operation, and the first warning mode is omitted and only the second warning mode is executed in printing operation. Even in such a manner, it is possible to notify the user as to whether proper bookbinding output will be executed, which prevents wasteful bookbinding output.

In the present embodiment also, zero is applied to the predetermined values to be compared with the left-hand sides of the expressions (3) to (7). However, the predetermined values can be properly and flexibly set, the same as in the first embodiment.

In accordance with the invention, a wasteful bookbinding output can be prevented.

What is claimed is:

1. An image forming system, comprising:

an image forming device that forms an image on a sheet, the image forming device including:

an operation unit for selection of the sheet and a cover to be used for bookbinding;

a start button operable by a user for starting an image forming provided in the operation unit; and a control unit for control of warning; and a bookbinding device that stacks a plurality of the sheets, forms a bundle of the sheets, and binds a book by wrapping the bundle of the sheets with the cover in a square-shape, the bookbinding device including:

a measuring unit for measurement of a thickness of the bundle of the sheets, wherein the image forming system is configured to operate in, a first warning mode that is executed before a depression of the start button and in a second warning mode that is executed after the start button is operated, wherein the control unit:

calculates a difference between a length of the selected cover, and a sum of twice a length of the selected sheet and a spine width, and determines a warning, based on a result of comparison between the difference and a predetermined value, and executes the determination of the warning in the first warning mode that determines issuing of a warning, based on the result for which the difference is calculated with a spine width of a set value, and in the second warning mode that determines issuing of a warning, based on the result for which the difference is calculated with a spine width of the measured thickness of the bundle of sheets.

2. The image forming system of claim 1, wherein the control unit executes the second warning mode after executing the first warning mode.

3. The image forming system of claim 2, wherein if the control unit has issued a warning in the first warning mode, the control unit prohibits bookbinding output.

4. The image forming system of claim 2, wherein if the control unit has issued a warning in the first warning mode, the control unit prohibits image forming.

5. The image forming system of claim 1, wherein the operation unit includes an input section for setting a spine width of the cover; and the set value of the spine width in the first warning mode is a set value of the spine width that is input via the input section.

6. The image forming system of claim 5, wherein if the control unit has issued a warning in the first warning mode, the control unit performs display for a prompt of re-input of a spine width via the input section.

7. The image forming system of claim 1, wherein the set value of the spine width in the first warning mode is at least one of a maximum spine width and minimum spine width having been set.

8. The image forming system of claim 1, wherein the control unit executes the second warning mode after the measuring unit has measured the thickness of the bundle of the sheets.

9. The image forming system of claim 8, wherein if the control unit has issued the warning in the second warning mode, the control unit prohibits bookbinding output after outputting the bundle of the sheets of which thickness having been measured.

10. The image forming system of claim 8, wherein if the control unit has issued the warning in the second warning mode, the control unit prohibits image forming for a bundle of sheets subsequent to the bundle of the sheets of which thickness having been measured.

11. The image forming system of claim 8, wherein the control unit outputs bookbinding without wrapping the bundle of the sheets of which thickness having been measured in a square shape with the cover.

12. The image forming system of claim 1, further comprising a cutting unit for cutting a cover, wherein the control unit sets a length of the cover to a value of subtraction of a cut width, to be cut by the cutting unit, from the length of the cover having been selected via the operation unit.

13. The image forming system of claim 1, wherein the measuring unit further includes:

a first sandwiching member for sandwiching the bundle of sheets;

a second sandwiching member that is disposed with an initial position having an initial distance from the first sandwiching member; and a motor for moving the second sandwiching member from the initial position;

and wherein the measuring unit measures the thickness of the bundle of sheets by sandwiching the bundle of sheets with the first sandwiching member and the second sandwiching member.

14. The image forming system of claim 13, wherein the measuring unit measures the thickness of the bundle of sheets, based on the initial distance between the first and second sandwiching members, and a moving amount of the second sandwiching member from the initial position.

* * * * *